United States Patent [19]

Strohmeyer

[11] Patent Number: 4,699,329

[45] Date of Patent: Oct. 13, 1987

[54] ARRANGEMENT FOR ROLLING UP AND UNROLLING OF MATERIAL WEBS

[75] Inventor: Willi Strohmeyer, Einbeck, Fed. Rep. of Germany

[73] Assignee: Willy Strohmeyer Maschinenbau, Einbeck, Fed. Rep. of Germany

[21] Appl. No.: 772,876

[22] Filed: Sep. 4, 1985

[30] Foreign Application Priority Data

Sep. 4, 1984 [DE] Fed. Rep. of Germany ..... 34324070

[51] Int. Cl.[4] ..... B65H 19/06; B65H 18/16; B65H 16/10

[52] U.S. Cl. ..... 242/65; 242/55.53; 242/67.3 R

[58] Field of Search ..... 242/65, 67.3 R, 55, 242/53

[56] References Cited

U.S. PATENT DOCUMENTS

| | | | |
|---|---|---|---|
| 2,632,607 | 3/1953 | Heygel | 242/65 |
| 3,250,483 | 5/1966 | Printz et al. | 242/65 |
| 3,279,718 | 10/1966 | Arterton et al. | 242/65 X |
| 3,299,484 | 1/1967 | Pernick | 242/67.3 R X |
| 3,669,372 | 6/1972 | De Jong | 242/55.53 X |
| 3,753,452 | 8/1973 | Zebley | 242/65 X |

*Primary Examiner*—Stuart S. Levy

*Assistant Examiner*—Thomas R. Hannon

*Attorney, Agent, or Firm*—Michael J. Striker

[57] ABSTRACT

An arrangement for rolling up and unrolling of material webs, particularly carpets, has a driving drum which is rotatable about its longitudinal axis and is supported displaceably horizontally displaceable in direction toward a rod for receiving an unrolling carpet and extending parallel to the driving drum with adjustable height. The drive of the roll of the carpet arranged on the rod is performed frictionally over the outer surface of the driving drum. By means of a single drive the driving drum is driven in rotation about its longitudinal axis and also applies the pressing force required for the frictional engagement with the carpet roll. For this purpose the drive is connected, on the one hand, directly with a chain wheel which rotates the driving drum about its longitudinal axis, and via a sliding coupling with further chain wheels which engage with stationarily clamped chains and thereby allow a horizontal displacement of the driving drum. The pressing force between the driving drum and the carpet roll is adjusted by the magnitude of the slippage moment of the slipping coupling. During rolling up of the carpet on the above mentioned rod, the driving drum which drives the material web roll of the increasing radius is displaced horizontally with constant pressing force.

16 Claims, 10 Drawing Figures

Fig. 1
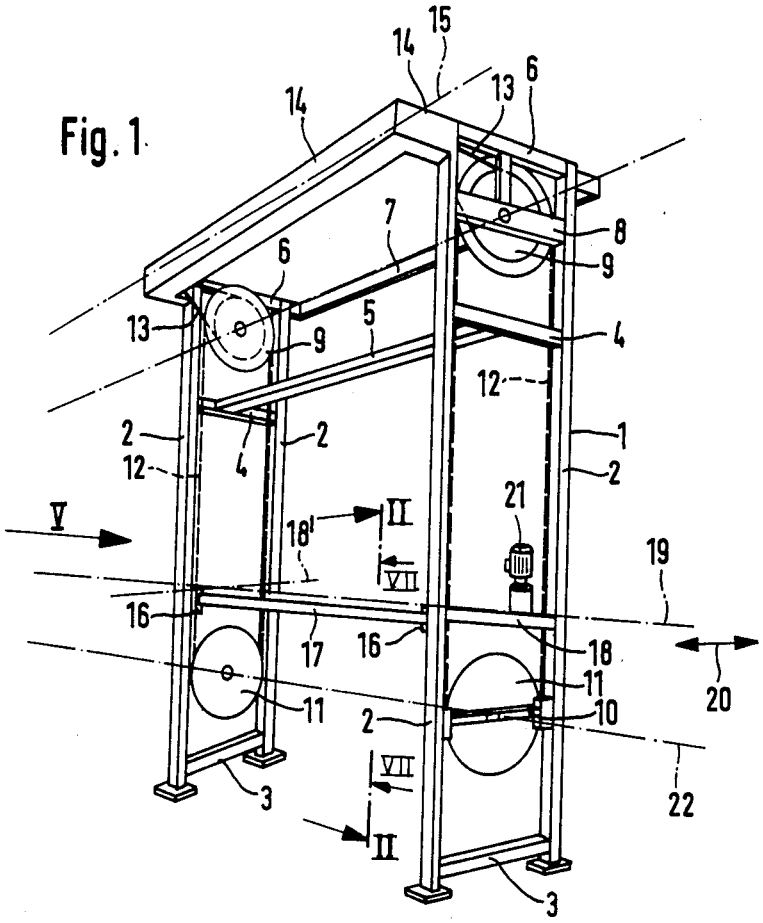
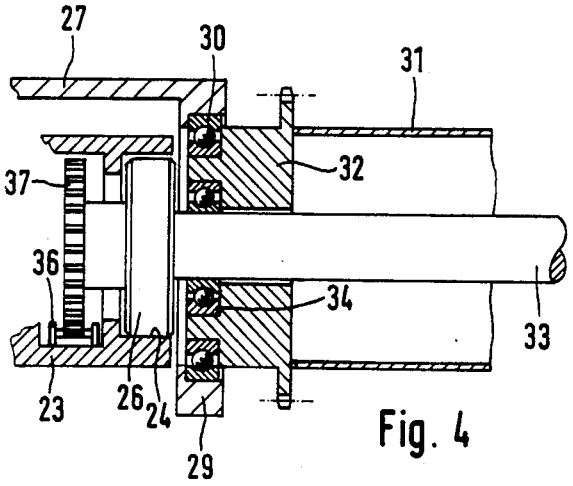
Fig. 4

Fig. 5
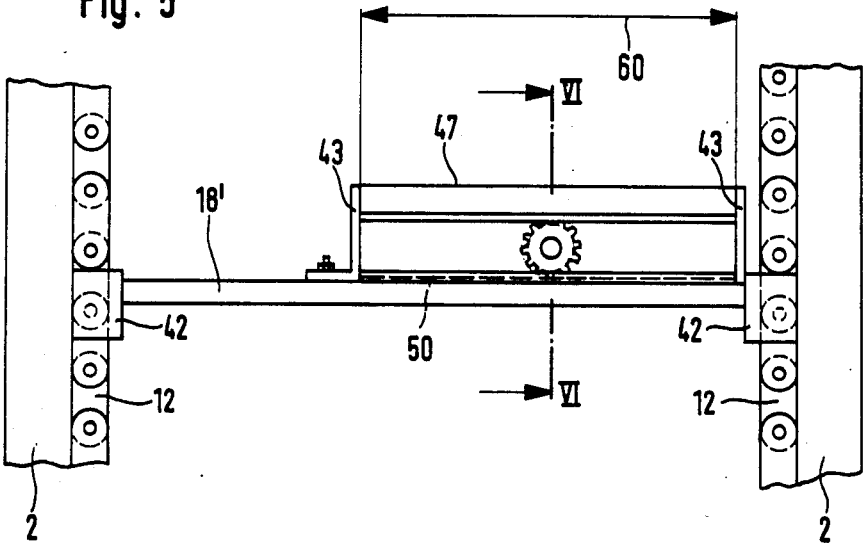
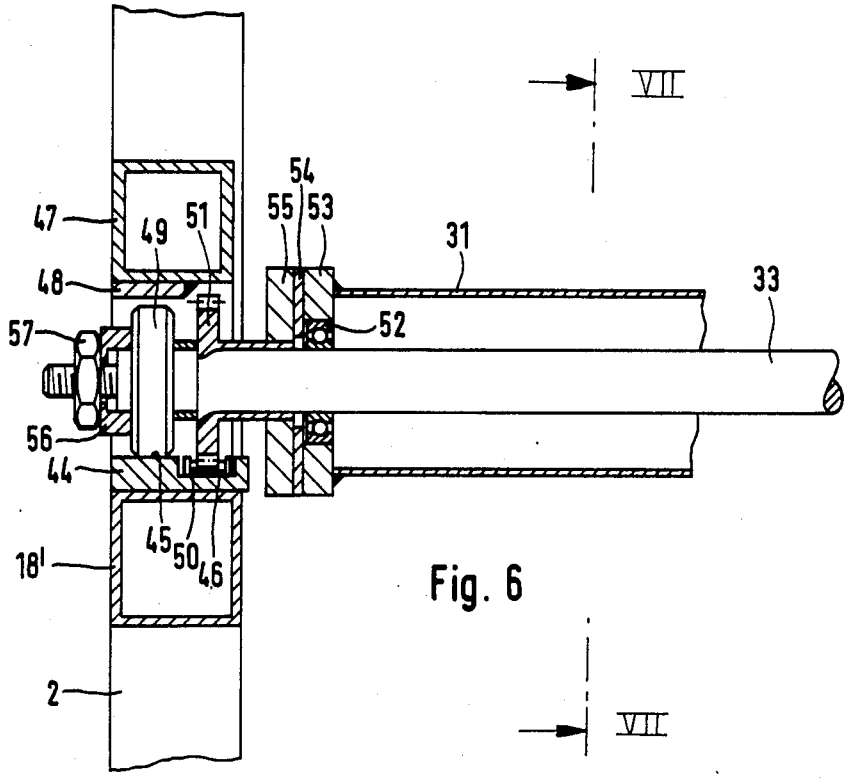
Fig. 6

ARRANGEMENT FOR ROLLING UP AND UNROLLING OF MATERIAL WEBS

BACKGROUND OF THE INVENTION

The present invention relates to an arrangement for rolling up and unrolling of material webs. More particularly, it relates to an arrangement for rolling up and unrolling of material webs, including a base frame with at least one horizontal rod for receiving a material web and with a driving device.

Arrangements of the above mentioned general type are known in the art. Frequently the problem exists that a carpet roll which is rolled up for transporting purposes with its lower or supporting side outwardly, must be unrolled so that its outer side is arranged outwardly for enabling a potential buyer to observe in a simple manner its properties and qualities in warehouses. Moreover, a carpet roll must frequently be partially unrolled for presentation purposes and then again rolled up. The manual performance of these operations is connected with extreme difficulties especially for large rolls, so that there is a demand to at least partially mechanize these operations.

SUMMARY OF THE INVENTION

Accordingly, it is an object of the present invention to provide an arrangement, by means of which flexible material webs, for example carpets, can be rolled up and unrolled in a simple manner.

In keeping with these objects and with others which will become apparent herein after, one feature of the present invention resides, briefly stated, in an arrangement of the above general type in which the driving device has a drive, and a driving drum which extends parallel to the above mentioned rod and is pressable against a material web roll, the rod is supported in a base frame in a suspended and vertically adjustable manner, and at least the driving drum is rotatable about its longitudinal axis and simultaneously horizontally displaceable in direction toward the roll and the rod.

The driving drum supported in the base frame extends along the entire length of the available roll so that the latter is provided with a uniform drive over its entire length for the purpose of rolling up and unrolling. Because of the horizontally displaceable support of the driving drum, a deflecting ability is provided for the latter in correspondence with the growing radius of the material web roll forming on the rod during the rolling up step, so that a uniform drive of the roll is independent of its size. The height-adjustable support of the rod which is advantageously stationary or in other words is not rotatable about its longitudinal axis serves for minimizing of friction forces which take place during the rolling process between the forming roll, on the one hand, and the rod, on the other hand. Finally the driving drum is pressable against the roll and it is substantially important that the magnitude of this pressing can be adjusted with the respective material properties of the handled roll. The arrangement in accordance with the present invention can be used for all types of flexible material webs, for example for carpets, floor coatings and the like.

In accordance with another feature of the present invention, the outer surface of the driving drum is provided with a friction coating, for example of a rubber-like material. This feature opens the possibility to provide with relatively low pressing forces between the roll and the driving drum, an effective drive of the arrangement.

Another feature of the present invention is that the drive for rotation of the driving drum about its longitudinal axis is coupled with the same and simultaneously is connected with means for horizontal displacement of the driving drum. This multiple use of a drive provides a very simple construction of the arrangement, so that for obtaining the required pressing force with the radially growing roll in other words along the horizontal displacement path of the driving drum no special means is required. Simultaneously the drive can be used in this manner for purely horizontal displacement of the driving drum.

Yet a further feature of the present invention is that the connection between means for horizontal displacement of the driving drum and the drive is formed as a sliding coupling with an adjustable slippage moment. The slippage moment of the sliding coupling can be adjusted via the pressing force between lamellas or disks which are arranged in frictional connection with one another. Also an electromagnetic slipping coupling or an inductive coupling can be considered for this purpose, whose slippage moment can be adjusted by a respective excitement current. The magnitude of this slippage moment directly influences the pressing force between the driving drum and the roll forming on the rod.

An additional feature of the present invention is that the horizontal displaceability of the driving drum is achieved in such a manner that it is movable at its one side directly and at its other side indirectly via wheels along transverse traverses mounted on the base frame of the inventive arrangement. A synchronous drive of both ends of the driving drum is provided by chains or toothed racks stationarily arranged on the transverse traverses and each engaging with a chain wheel or a toothed wheel, wherein both chain wheels or toothed wheels are mounted on a joint shaft. The drive associated with the driving drum drives primarily directly the driving drum which is fully rotatable relative to the above mentioned shaft and is connection with the same via a sliding coupling. The energy which is applied by the drive is branched via the sliding coupling in correspondence with the adjusted slippage moment and used for pressing of the driving drum against the roll which is formed on the rod.

A further advantageous feature of the present invention is that the base frame has mounting means for a further rod for receiving a roll from a material web, which extends horizontally and parallel to the first mentioned rod. This feature is very important for unrolling. No additional means is required for placing of the respective unrolling rolls.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view of an arrangement for rolling up and unrolling of material webs, in accordance with the present invention;

FIG. 4 is an enlarged view of FIG. 3, partially in section;

FIG. 5 is a view in direction of the arrow V in FIG. 1;

FIG. 6 is a view showing a section taken along the line VI—VI in FIG. 5;

DESCRIPTION OF A PREFERRED EMBODIMENT

Figure 2:
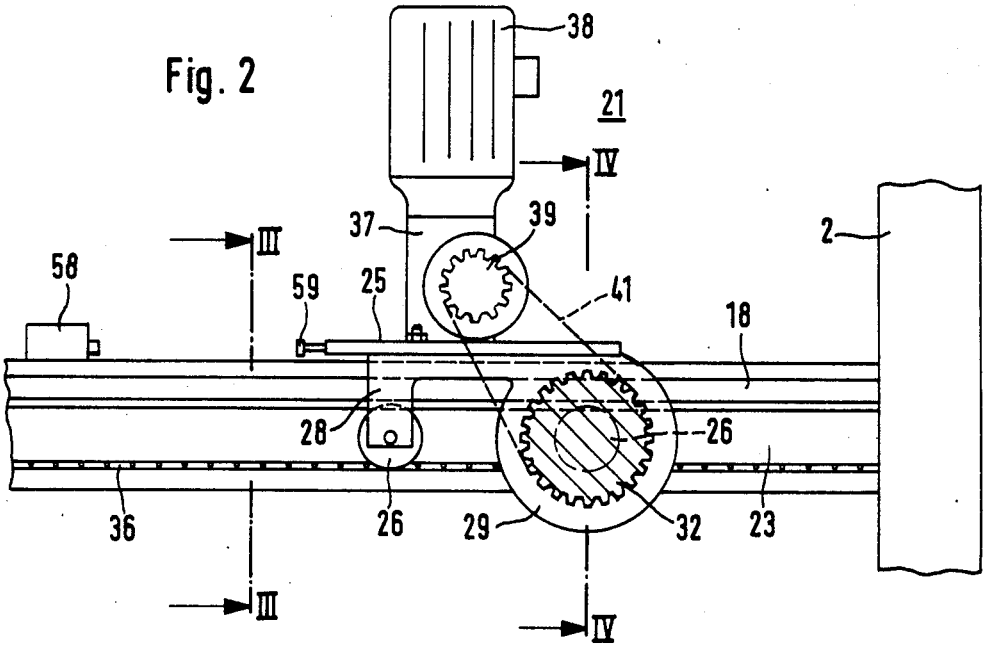
FIG. 2 is a view showing a vertical section of the arrangement of FIG. 1, taken along the line II—II.

FIG. 1 shows in general a rolling arrangement in accordance with the present invention. It has a main frame which is identified with reference numeral 1 and includes four vertically arranged supports 2 which have approximately square crosssection. Each two neighboring supports 2 are connected with one another in their lower and upper region by traverses 3 and 4 which are welded to the supports 2. The upper traverses 4 of both pairs of the supports 2 are connected with one another by means of a longitudinal support 5. Further traverses 6 which connect respective two pairs of the supports 2, and a further longitudinal support 7 form the upper connection of the base frame.

Bearing supports 8 are located in the upper region of the base frame and each connect two neighboring supports 2. They form the bearing for chain wheels 9. Moreover, each two neighboring supports 2 are connected in the lower region of the base frame by further bearing traverses 10 each serving also as the bearing for a chain wheel 11. Each pair of the chain wheels 9, 11 supported on each pair of the supports 2 is in a form-locking connection by a respective chain 12 which is shown in broken lines in FIG. 1.

Both upper chain wheels 9 have two toothed rims. One of the rims serve for guiding the chain 12, while the other of the rims serves for guiding a driving chain 13. The upper chain wheels 9 are directly driveable via the chains 13 by means of a not shown electric drive located at the location identified with reference numeral 14. A shaft which is not shown in the drawing and extends inside an upper hollow longitudinal traverse 14 has an axis identified by dash-dot line 15. By means of this shaft both upper chain wheels 9 are driven completely synchronically.

A bearing piece 16 can be suspended in a not shown manner in the chain 12 and serves for bearing of a rod 17. The rod 17 serves for receiving a rolling up or unrolling carpet roll, and is non-rotatably supported in the bearing pieces 16. This will be explained later in detail. The height of the rod 17 is adjustable by means of the chain 12.

Further transverse traverses are identified with reference numerals 18 and 18'. The transverse traverse 18' is shown only in dash-dot line. The transverse traverses 18 and 18' serve for receiving of a driving roller whose axes is shown by a dashdot line 19. The driving roller can be displaced in direction of the arrow 20 horizontally and vertically to the longitudinal axis of the driving roller by means of a drive 21 which will be described later on.

The lower chain wheels 11 are formed so that in the region of their hubs a rod can be suspended with an axis identified by a dot-dash line 22. This rod can serve for receiving an unrolling carpet roll.

An exemplary utilization of the rolling arrangement in accordance with FIG. 1 can be such that a carpet roll arranged on the non-rotatable rod which connects the lower chain wheels 11, is unrolled by means of a not shown driving roll onto the rod 17. In this manner the point of support of a carpet faces inwardly on optical grounds for better visibility of its outer side.

The driving roller and particularly its side which faces the drive 21 is described in connection with FIGS. 2–4 herein below, and the elements which correspond to the elements of FIG. 1 are provided with the same reference numerals so as to prevent repetition of the above description.

A rail-like guiding device 23 is mounted on the transverse traverse 18 for example by screwing and extends along a part of the transverse traverse 11. A rolling track 24 is formed inside the guiding device 23. Two wheels 26 mounted horizontally at a distance from one another on a carriage 25 are supported on the rolling track 24.

The carriage 25 has substantially a base plate 27 with a first bearing holder 28 and a second bearing holder 29 mounted on the base plate, for example by welding.

A chain wheel 32 which is in fixed connection with a driving drum 31 is supported by the bearing holder 29 via an outer roller bearing 30. The chain wheel 32 is connected with the driving drum 31 for example by a peripheral welding. Advantageously the hollow driving drum 31 is coated on its outer side with a coating layer 61 which increases a friction force and can be composed for example of a rubber material. A shaft 33 extends through the hollow chain wheel 32 and is supported in the chain wheel by roller bearing 34. A wheel 26 is supported freely rotatably on the shaft 33.

The guiding device 23 is provided with a groove 35 extending similarly to the rolling track 24 in its longitudinal direction and receiving a chain 36. The ends of the chain 36 are braced in a not shown manner with the ends of the guiding device 23. A chain wheel 37 engages with the chain 23 and is arranged on the shaft 33 at the side of the wheel 26 which faces away from the driving drum 31.

The base plate 27 carries a transmission 37 and a motor 38 which is mounted on one another and on the base plate 27 by screwing. Reference numeral 39 identifies a chain wheel which is arranged on an output shaft 40 of the transmission and is in engagement via a chain 41 with the chain wheel 32 of the driving drum 31. By means of the motor 38 the chain drive of the driving drum 31, which is formed by the chain wheels 39 and 32, can be rotated about a longitudinal axis identified by the dash-dot line 19 in FIGS. 1 and 3.

The bearing of the driving drum 31 at the end facing away of the drive 21 is described herein below with reference to FIGS. 5 and 6, and the elements which are similar to the elements in FIGS. 1–4 are identified with the same reference numerals.

The traverse 18' is mounted on two opposite supports 2 with interposition of holding pieces 42 in a suitable manner. Mounting elements 43 are arranged on the traverse 18' and extend substantially vertically. One of these mounting elements which are arranged at a distance from one another and connected with the transverse traverse 18' for example by screwing, is located in the immediate vicinity to a vertical support.

A guiding device 44 is arranged between the mounting elements 43 and the transverse traverse 18', for example by welding. One part of the guiding device 44 forms a rolling path 45, while the other part of the same is formed as a groove 46. Both the groove 46 and the rolling path 45 extend in the longitudinal direction to the rail-like guiding device 44 and thereby also in the longitudinal direction of the transverse traverse 18'.

A transverse support 47 extends between the mounting elements at a distance above the guiding device 44. A guiding strip 48 is welded on the lower side of the transverse support 47. The distance between the lower edge of the guiding strip 48 and the upper edge of the rolling path 45 is dimensioned so that a wheel 49 can be rolled in a horizontal direction over the rolling path 45 with a small play. The wheel 49 is supported on the shaft 33 and particularly on its end facing away of the drive 21 in a freely rotatable manner.

A chain 50 extends inside the groove 46 and is clamped in suitable manner on the mounting elements 43. The chain 50 engages with a chain wheel 51 which is mounted non-rotatably on the shaft 33.

The driving drum 31 is supported by means of a rolling bearing 52 on the shaft 33. A closing disk 53 of the driving drum 31 receives the roller bearing 52 and cooperates with a friction disk 54 which is pressed in turn against a disk 55. The disk 55 is in form-locking connection with the chain wheel 51. The pressing force of the disk 55 relative to the friction disk 54 and the closing disk 53 can be adjusted by means of a pressure ring 56 and a nut 57. The closing disk 53, the friction disk 54 and the disk 55 form in cooperation with the pressure ring 56 and the nut 57 a sliding coupling whose slippage moment can be adjusted by means of the nut 57.

The operation of the inventive rolling arrangement is described herein below, and in particularly its utilization for unrolling of a carpet formed as a roll with a supporting side facing outwardly, and which must be unrolled so that the outer side of the carpet faces outwardly.

The unrolling carpet roll is first placed for this purpose on a rod which is mounted in the region of the hubs of the lower chain wheel 11. One end of this roll is placed around the rod 17 and clamped by driving of the driving roller 31 on the rod 17. The driving of the driving drum 31 is performed by means of the motor 38 which drives over the chain 41 the driving drum 31 coupled via the friction disk 54 with the shaft 33 which in turn engages via the chain wheels 51 and 37 the chains 50 or 36 mounted on the guiding device 44 or 23. The horizontal movement of the driving roller is obtained thereby via the chain wheels 51 and 37. The height of the rod 17 relative to the driving roll is adjusted by displacement of the chain 12 so that the longitudinal axis of the driving drum 31 is located underneath the longitudinal axis of the rod 17. Thereby a pressing force acts from the driving drum upon the roll to be formed on the rod 17 below a horizontal plane which contains the longitudinal axis of the rod 17. During the further actuation of the motor 38 the roll formed because of the rotatable driving drum in a frictional manner on the rod 17 rotates further, while the roll which is held by the chain wheels 11 is unrolled. Both the unrolling and the rolling-up carpet rollers move during the rolling process on cardboard ferrules which rotate over stationary rods. These rods include the rod 17, on the one hand, and a rod which connects the chain wheels 11, on the other hand. The motor 38 must thereby apply during the rolling process such friction forces which unwound by friction the cardboard ferrules on the rods. The roll on the rod 17 which during the rolling step grows with its diameter applies upon the driving drum a horizontally directed pressing force by which the driving drum is horizontally displaced from the rod 17. Because of the coupling of the motor 38 via the friction disk 54 with the chain wheels 37 and 51, a movement of the driving drum is obtained which is directed to the rod 17 so that a displacement of the driving drum in opposite direction is possible only under overcoming of the horizontal force which is supplied via the chain wheel 37 and 51. The magnitude of the above mentioned force to be overcome is determined quantitatively by the amount of the slippage moment which acts between the disk 55, the friction disk 54 and the closing disk 53 and can be adjusted by the nut 57. In this manner during growing of the roll which is formed on the rod 17 and unrolled, a sufficient and constant pressing force of the driving drum is provided. It is important that the motor 38 simultaneously applies the driving force which is required for the rotation of the carpet roll to be formed and the carpet roll which is unrolling, and moreover by means of the slippage moment adjustable by the nut 57 an equally constant pressing force is produced between the driving drum and the carpet roll.

Figure 3:
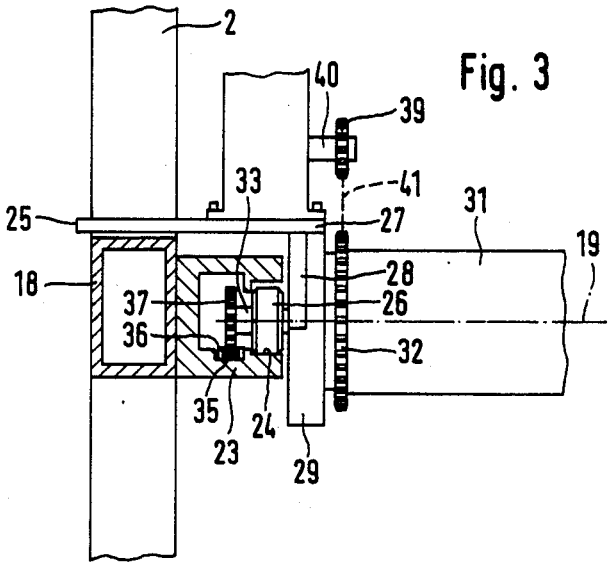
FIG. 3 is a view showing a section of inventive arrangement, taken along the line III—III in FIG. 2.
Figure 7:
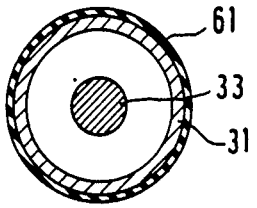
FIG. 7 is a view showing a section taken along the line VII—VII in FIG. 6.
Figure 8:
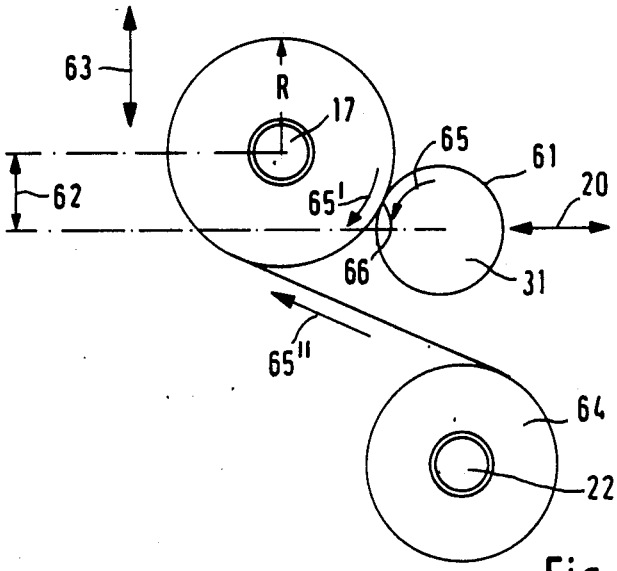
FIG. 8 is a view showing a section taken along the line VIII—VIII in FIG. 1.
Figure 9A:
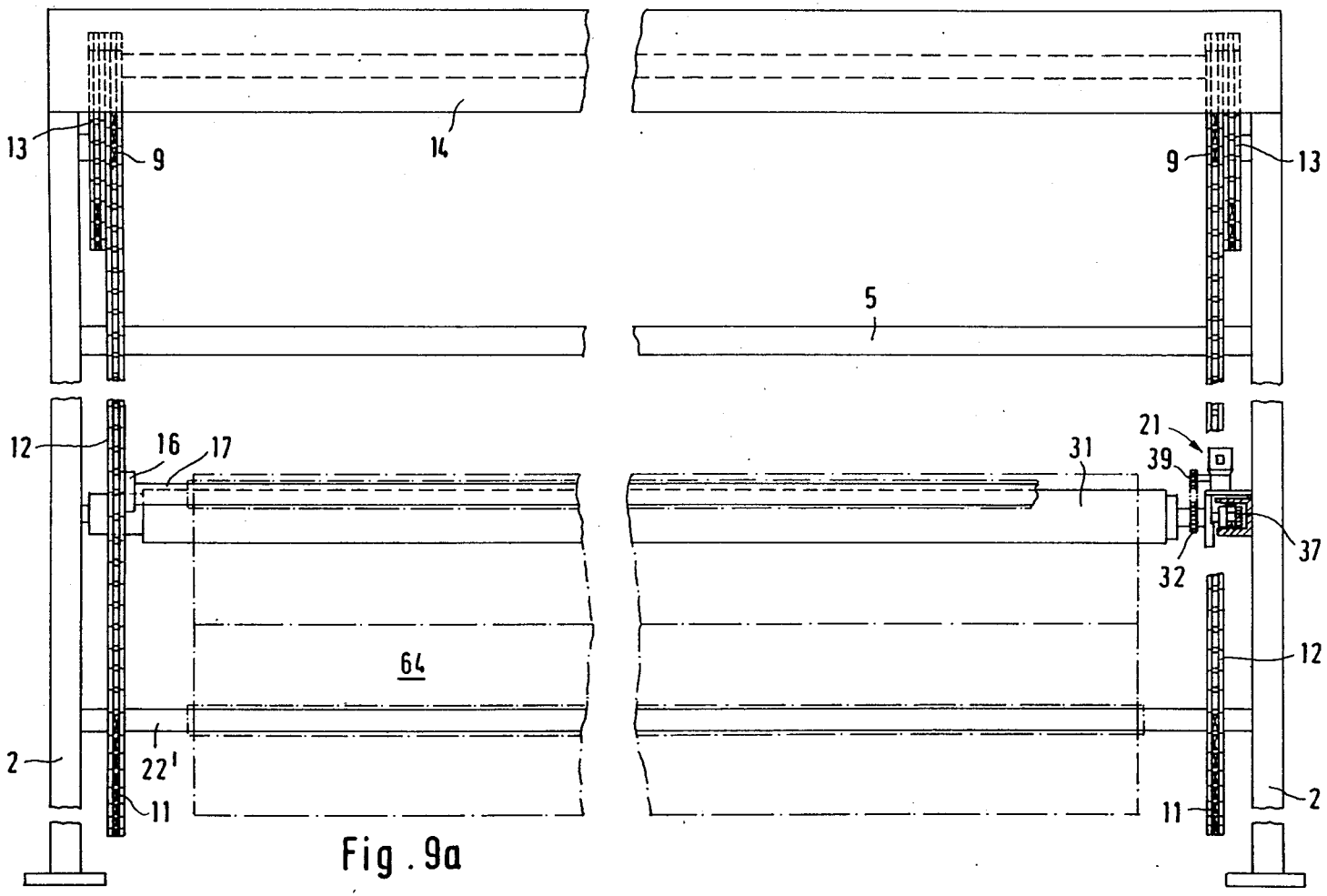
FIG. 9*a* is a front view of the arrangement of FIG. 1.
Figure 9B:
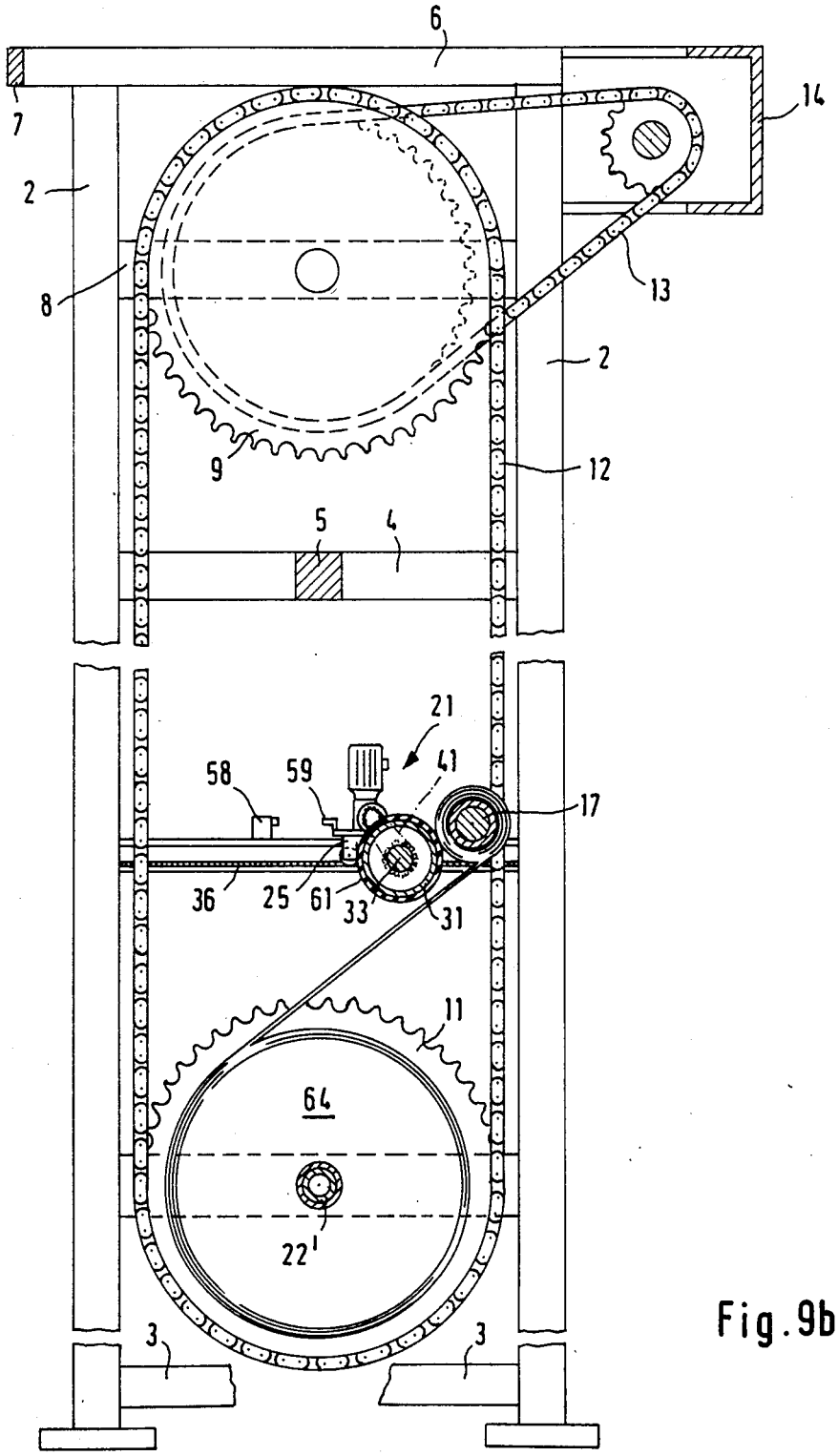
FIG. 9*b* is a vertical section of the whole arrangement, in a plane extending through the line VIII—VIII.

An end switch is identified with reference numeral 58 in FIG. 2. It cooperates with a pusher 59 which is mounted on the carriage 25. By the adjustment of the end switch 58 on the transverse traverse 18, it is possible to determine the region within the driving drum 31 moves horizontally. This region is identified in FIG. 5 by the arrow 60. The drawings do not show electrical control devices whose construction and operation can become clear from the above presented description.

It will be understood that each of the elements described above, or two or more together, may also find a useful application in other types of constructions differing from the types described above.

While the invention has been illustrated and described as embodied in an arrangement for rolling and unrolling of material webs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for rolling and unrolling of coil-like flexible material webs, particularly carpets, comprising a base frame; at least one horizontally extending rod mounted on the base frame and arranged for for receiving a roll of a material web; driving means arranged in said base frame, said driving means including a drive and a driving drum which extends parallel to said rod and is pressable against a material web roll carried on said rod, said rod being supporting in said base frame in a suspended and vertically adjustable manner, at least said driving drum being arranged rotatably about its longitudinal axis and simultaneously displaceably in direction toward the material web roll or said rod, said drive being coupled with said driving drum for rotation of the latter about its longitudinal axis; and means for horizontal displacement of the driving drum, said drive being simultaneously connected with said means for horizontal displacement of said driving drum.

2. An arrangement as defined in claim 1; and further comprising means for adjusting a pressing force between the material web roll or said rod, on the one hand, and said driving drum.

3. An arrangement as defined in claim 1, wherein said driving drum has an outer surface provided with a friction coating.

4. An arrangement as defined in claim 3, wherein said friction coating on said outer surface of said driving drum is composed of a rubber-like material.

5. An arrangement as defined in claim 1; and further comprising a further rod which is arranged for receiving a roll from a material web, said further rod extending horizontally and parallel to said first-mentioned rod and mounted on said base frame; and further comprising mounting means for mounting said further rod on said base frame.

6. An arrangement as defined in claim 1; and further comprising means for connecting said means for horizontal displacement of said driving drum and said drive for rotating said driving drum, said connecting means including a slipping clutch with an adjustable slippage moment.

7. An arrangement as defined in claim 1; and further comprising a first transverse traverse and a second transverse traverse mounted on said base frame, said means for horizontal displacement of said driving drum including a carriage in which an end of the driving drum is supported and which is movable along said first transverse traverse, and at least one wheel in which another end of said driving drum is supported and which is movable along said second transverse traverse.

8. An arrangement as defined in claim 7; and further comprising a roller bearing arranged for supporting said first mentioned end of said driving drum in said carriage.

9. An arrangement as defined in claim 7, and wherein said carriage supports said drive and mounted on said second transverse traverse by two horizontal wheels which are arranged at a distance from one another.

10. An arrangement as defined in claim 7; and further comprising means for horizontally driving said driving drum and including a shaft which extends through said driving drum and has end regions extending outwardly beyond the latter, driving wheels arranged on said end regions of said shaft, driving elements engaging with said driving wheels, and a sliding coupling provided on one end of said driving drum and connecting the latter with said shaft.

11. An arrangement as defined in claim 10, wherein said driving wheels are formed as chain wheels and said driving elements are formed as chains.

12. An arrangement as defined in claim 10, wherein said wheels are formed as toothed wheels and said driving elements are formed as toothed racks.

13. An arrangement as defined in claim 10, wherein said driving elements are arranged on said first and second transverse traverses which are mounted on said base frame.

14. An arrangement as defined in claim 10; and further comprising a first wheel which is arranged to roll on one of said transverse traverses and is rotatably supported on said shaft, and at least one second wheel which is arranged to support said carriage and is freely rotatably supported on said shaft, said shaft being supported inside said driving drum.

15. An arrangement as defined in claim 14; and further comprising a plurality of such second wheels arranged for supporting said carriage and freely rotatably on said shaft.

16. An arrangement as defined in claim 14; and further comprising a roller bearing by means of which said shaft is supported inside said driving drum.

* * * * *